US005826387A

United States Patent [19]

Henderson et al.

[11] Patent Number: 5,826,387

[45] **Date of Patent: *Oct. 27, 1998**

[54] PIER FOUNDATION UNDER HIGH UNIT COMPRESSION

[76] Inventors: Allan P. Henderson, 5919 Mohawk Dr., Bakersfield, Calif. 93308; Miller B. Patrick, 5808 Baywood, Bakersfield, Calif. 93309

[ * ] Notice: The term of this patent shall not extend beyond the expiration date of Pat. No. 5,586,417.

[21] Appl. No.: 773,053

[22] Filed: Dec. 24, 1996

Related U.S. Application Data

[63] Continuation-in-part of Ser. No. 346,935, Nov. 23, 1994, Pat. No. 5,586,417.

[51] Int. Cl.[6] ..... E02D 5/38; E02D 27/32

[52] U.S. Cl. ..... 52/295; 52/223.4; 52/296; 405/249; 405/251; 405/256

[58] Field of Search ..... 52/223.4, 223.5, 52/294, 295, 296, 741.11, 741.14, 741.15, 742.14; 405/229, 231, 232, 233, 236, 237, 238, 239, 242, 249, 251, 255, 256

[56] References Cited

U.S. PATENT DOCUMENTS

| | | | |
|---|---|---|---|
| 1,048,993 | 12/1912 | Meriwether . | |
| 2,162,108 | 6/1939 | Newman | 405/239 |
| 2,374,624 | 4/1945 | Schwendt . | |
| 2,706,498 | 4/1955 | Upson . | |
| 2,724,261 | 11/1955 | Rensaa . | |
| 3,186,181 | 6/1965 | Snow et al. . | |
| 3,382,680 | 5/1968 | Takano . | |
| 3,559,412 | 2/1971 | Fuller . | |
| 3,600,865 | 8/1971 | Vanich . | |
| 3,839,874 | 10/1974 | Wyant . | |
| 3,842,608 | 10/1974 | Turzillo . | |
| 3,963,056 | 6/1976 | Shibuya et al. . | |
| 3,963,065 | 6/1976 | Dauwalder . | |
| 4,038,827 | 8/1977 | Pryke | 405/239 |
| 4,060,994 | 12/1977 | Chitis | 405/238 |
| 4,228,627 | 10/1980 | O'Neill . | |
| 4,287,691 | 9/1981 | Guenther . | |
| 4,618,287 | 10/1986 | Kinnan . | |
| 4,842,447 | 6/1989 | Lin . | |
| 4,910,940 | 3/1990 | Grady, II | 52/223.5 X |
| 5,131,790 | 7/1992 | Simpson | 405/233 X |
| 5,228,806 | 7/1993 | De Medieros, Jr. et al. . | |
| 5,379,563 | 1/1995 | Tinsley . | |
| 5,586,417 | 12/1996 | Henderson et al. . | |

*Primary Examiner*—Lanna Mai
*Assistant Examiner*—Kevin D. Wilken
*Attorney, Agent, or Firm*—Jacobson, Price, Holman & Stern, PLLC

[57] ABSTRACT

An upright cylindrical pier foundation is constructed of cementitious material. The lower end of the foundation has a plate or circumferential ring fully embedded therein and long circumferentially spaced rods or bolts have their lower ends anchored relative to the ring. The upper ends of the long rods project up outwardly of the top of the foundation. The rods are shielded over substantially their entire length against bonding with the cementitious material to allow the rods, when heavily tensioned, to stretch within the cementitious material. A heavy flange, which may comprise the base flange of a tubular tower, is positioned downwardly upon the upper end of the foundation with the upper ends of the bolts projecting through holes provided therefor in the base flange. Nuts are threaded downwardly upon the upper ends of the bolts and against the base flange under high torque in order to place the bolts in heavy tension and substantially the entire length of the cylindrical foundation under high unit compressive loading. The pier foundation may include a diametrically enlarged upper end shoulder portion whose outer peripheral portion includes additional circumferentiallv spaced heavily tensioned short rods anchored between a second anchor plate or ring embedded in the shoulder portion and a second flange or ring seated downwardly on the shoulder portion upper end. Also, the long rods may include shorter rod sections suitably coupled together and sections of the foundation may be precast with the sheathed rods in place.

19 Claims, 10 Drawing Sheets

PIER FOUNDATION UNDER HIGH UNIT COMPRESSION

This application is a continuation-in-part of U.S. application Ser. No. 08/346,935, for Tensionless Pier Foundation, filed Nov. 23, 1994, now U.S. Pat. No. 5,586,417, dated Dec. 24, 1996.

BACKGROUND OF THE INVENTION

1. Field of the Invention

This invention relates to concrete foundations particularly useful for the support of tall, heavy and/or large towers which may be used to support power lines, street lighting and signals, bridge supports, wind turbines, commercial signs, freeway signs, ski lifts and the like.

2. Description of Related Art in Relation to Present Invention

Various different forms of foundations utilizing some of the general structural and operational features of the instant invention heretofore have been known, such as those disclosed in U.S. Pat. Nos. 1,048,993, 2,374,624, 2,706,498, 2,724,261, 3,186,181, 3,382,680, 3,559,412, 3,600,865, 3,839,874, 3,842,608, 3,963,056, 4,228,627, 4,287,691, 4,618,287, 4,842,447, 5,228,806 and 5,379,563. However, these previously known foundations do not include some of the basic features of the instant invention, and the combination of features incorporated in three of the five disclosed forms of the instant invention enable a heavy duty foundation with a slenderness ratio of less than 3 to be formed in situ and in a manner not requiring the use of large drilling rigs or pile drivers, two of the five disclosed forms being pre-cast. The combination comprising the present invention, all disclosed forms included, results in a foundation capable of resisting very high upset loads in various types of soils and in a manner independent of the concrete of the foundation experiencing alternating localized compression and tension loading.

U.S. Pat. No. 2,374,624 to P.J. Schwendt discloses a foundation intended for supporting signal masts, supply cases and signals. The foundation consists of pre-cast sections of concrete bolted together. The composite foundation is embedded in soil. The mounting of a tall mast section for signals on this foundation would subject the foundation to some overturning moment, and the Schwendt foundation is only applicable to relatively small structures, inasmuch as it is constructed from pre-cast sections which necessarily impose size limitations on the foundation and therefore the structure supported thereon.

In comparison, the pier foundation of the instant invention can be poured-on-site monolithically and is of cylindrical construction with many post-tensioned anchor bolts which maintain the poured portion of the foundation under heavy compression, even during periods when the foundation may be subject to high overturning moment.

U.S. Pat. No. 2,706,498 to M.M. Upson discloses a pre-stressed tubular concrete structure particularly adapted for use as pipe conduits, concrete piles and caissons. The pre-stressed tubular concrete structure is pre-cast in sections and can be assembled end-to-end. Longitudinal reinforcing steel is provided and extends through cavities, is tensioned and grouted tight, therefore pre-stressing helical wire windings which are tensioned providing circumferential pre-stressing. The Upson structure is pre-stressed and not of a size diameter suitable as a foundation for tall support towers or columns subject to high upset moment and would be very difficult to transport to a remote area of use.

In contrast, the foundation of the instant invention may be poured on site monolithically and, therefore, in the case of a remote point of use, needs only transportation for the ingredients of concrete, corrugated pipe sections and tension bolts to the construction location and only to the extent necessary to construct the foundation in accordance with the present invention.

U.S. Pat. No. 2,724,261 to E. M. Rensaa discloses a pre-cast column and means for attaching the column to a substantially horizontal supporting surface such as a footing or wall and which is otherwise not suitable for use as a large or tall tower foundation.

U.S. Pat. No. 3,600,865 to Francesco Vanich discloses a single column-borne elevated house unit erected by assembling, on a cast in situ foundation pillar, column sections provided with means for fastening the same together and to the foundation pillar above the pillar and by also fastening to the column sections radially arranged cantilever beams. The assembled parts are fastened together and to the foundation pillar by tendon sections which are first coupled together by joints, and then tensioned and eventually bonded to the concrete of the assembled parts by forcing grout in the clearance fully around the tendon rods.

The Vanich house foundation is supported either on a large diameter pile cast or otherwise forced into the ground or inserted with its base portion into a small diameter pit whose peripheral walls and bottom are coated with a thick layer of preferably reinforced concrete. Sheathed steel rods are placed into the pit which is then filled with concrete. Before the concrete is completely hardened, a light prefabricated base is fitted thereon with screw threaded rods extending through the base.

U.S. Pat. No. 3,963,056, to Shibuya et al. discloses piles, poles or like pillars comprising cylindrical pre-stressed concrete tubes or pillar shaped pre-stressed concrete poles with an outer shell of steel pipe. While inclusion of the outer steel pipe as the outer shell increases the compressive strength of the concrete tube or pole by preventing the generation of lateral stress within the concrete tube or pole in a radial direction, the outer steel shell provides little resistance to tension stresses imposed upon the concrete due to swaying or side-to-side movement of tall towers supported on the foundation. In contrast, the pier foundation of the instant invention is post-stressed sufficiently to place the entire vertical extent of the concrete portion of the foundation under compression which considerably exceeds any expected tension loading thereof.

U.S. Pat. No. 1,048,993, to C. Meriwether discloses a reinforced concrete caisson which can be sunk in the usual way. Then, if desired, the caisson may be filled with concrete to form a pier. The reinforced concrete caisson is pre-cast into tubular sections of concrete with heavy large-mesh fabric of wire reinforcement and metal rings embedded at the ends for bolting sections together at a bell and spigot joint. Tie-rods extend through the connecting rings on the inside of the reinforced concrete tube to connect the section together. However, the tensioned tie-rods of Meriwether are spaced inward of the inner peripheries of the concrete tubes and do not pass through the thick wall concrete construction itself.

U.S. Pat. No. 3,382,680, to T. Takano discloses a pre-stressed concrete pile section, as opposed to a post-compressed pile construction, and incorporates tensioning wires which are embedded in the surrounding concrete and thus are not capable of stretching relative to the surrounding post-cured concrete.

U.S. Pat. No. 3,559,412, to F. M. Fuller discloses a reinforced concrete pile whose reinforcement comprises static reinforcement only and which is in intimate contact with the surrounding concrete and is not capable of stretching relative to the surrounding post-cured concrete.

U.S. Pat. No. 3,842,608, to L. Turzillo discloses a pile including outer spiral flutes enabling it to be screwed into the ground. Further, the Turzillo pile does not include an open top and an open bottom and further does not include structure whereby the pile is post-compressed.

U.S. Pat. No. 4,228,627, to J. O'Neill discloses a reinforced foundation structure incorporating vertical rods or bolts, but these rods or bolts include lower ends anchored relative to radial reinforcing rods as opposed to a peripherally continuous anchor ring embedded in the lower end of the concrete structure and, accordingly, the O'Neil structure is not capable of being placed under high unit compressive loading.

Finally, U.S. Pat. No. 5,379,563, to C. Tinsley discloses an anchoring assembly by which heavy machinery may be anchored to a foundation. However, no continuous lower anchor ring is provided and there is no peripherally continuous upper ring through which the anchoring bolts extend. Accordingly, although peripherally spaced portions of the Tinsley foundation can be placed under compression, there is no structure by which the Tinsley foundation may be placed under high unit compressive loading.

SUMMARY OF THE INVENTION

The foundation of the instant invention is unique because it eliminates the necessity for reinforcing steel bars (rebar tension bars), substantially reduces the amount of concrete used, and therefore the cost of the foundation compared to conventional designs, simplifies the placement of the supported structure on the foundation, and eliminates alternating cyclical compression and tension loading on the foundation, thereby substantially reducing fatigue. Also, the foundation construction of the present invention allows for the replacement of the tower anchor bolts in the unlikely event of bolt failure and, in three of the disclosed forms, allows removal of the upper four to five feet of the foundation in the event such action is desired for decommissioning purposes.

In a normal concrete pier foundation the concrete bears the compressive loads and the contained reinforcing bars (rebar) bear the tensile loads. The anchor bolts are typically placed within the reinforcing bar matrix using a removable template at the top and a separate anchor plate at the bottom of each bolt. The entire module is poured in concrete. As the foundation is loaded by the structure supported therefrom, the unit is subjected to varying tensile and compressive loads with there being a boundary at the bolt anchor plates where the loading on the concrete alternates from a compressive load to a tensile load depending upon the various forces on the supported structure. The tensile load from the overturning moment of the supported structure is applied near the top of the foundation by the anchor bolts and subjects the large portion of the foundation below the point of application to tension. The large foundation typically requires a great amount of reinforcing steel and a large amount of concrete to encase the reinforcing steel. Extensive labor is also necessary to assemble the reinforcing steel matrix and fill the volume of the foundation with concrete and fix the anchor bolts. A typical cylindrical foundation also requires the use of a large drill to excavate the hole.

The foundation of the instant invention is preferably in the shape of a concrete cylinder. The outer boundary shell of the concrete may be formed by corrugated metal pipe. The inner boundary, preferably in large hollow cylinder foundations, also may be formed by corrugated metal pipe of lesser diameter. Elongated high strength steel bolts then run from a peripheral anchor plate or ring near the bottom of the cylinder vertically up through "hollow tubes" extending vertically through the concrete portion of the foundation to a peripheral connecting plate or flange adjacent the upper end of the structure. The bolt pattern may be determined by the bolt pattern on the plates or flanges. That pattern may also be engineered in the construction of the foundation by a removable template. The "hollow tubes" are preferably elongated plastic tubes which encase the bolts substantially through the entire vertical extent of the concrete and allow the bolts to be tensioned after the concrete has hardened and cured, thereby post-tensioning the entire concrete foundation. Alternatively, the elongated bolts can be wrapped in plastic tape, or coated with a suitable lubrication, which will allow the bolts to stretch under tension over the entire operating length of the bolt through the vertical extent of the concrete. There is typically no rebar reinforcing steel in the foundation, except perhaps in large foundations where a small amount of incidental steel may be used to stabilize the bolts during construction. The costs of the elongated bolts and nuts is significantly less than the cost of reinforcing steel, the placement of the steel and necessary anchor bolts associated with conventional foundations.

The center of a large hollow cylindrical foundation is filed with excavated soil and then capped. Excavation for the foundation may be done using widely available, fast, low cost excavating machines instead of relatively rare, slow, costly drills necessary for conventional cylindrical foundations.

The design of the foundation of the instant invention uses the mechanical interaction with the earth to prevent over turning instead of the mass of the foundation typically used by other foundations for tubular towers. The foundation of the instant invention thus greatly reduces the costs by eliminating the need to fabricate reinforcing steel matrices and to locate and connect the anchor bolts within the reinforcing bar matrix, and by reducing the amount of concrete required and excess excavating costs such as those required for typical cylindrical foundations.

The high strength bolts are tightened to provide heavy tension on the foundation from a heavy top flange through which the bolts pass to the anchor flange or plate at the bottom of the foundation, thereby post-stressing the concrete in great compression and placing the entire foundation, between the heavy top plate or flange and lower anchor plate or flange, under high unit compression loading. The bolts are tightened so as to exceed the maximum expected overturning force of the tower structure on the foundation. Therefore, the entire foundation withstands the various loads with the concrete thereof always in compression and the bolts always in static tension. In contrast, conventional foundations, in which the bolt pattern is set in concrete in a reinforcing bar matrix, experience alternating tensile and compressive loads on the foundation concrete, reinforcing bars and anchor bolts, thereby Producing loci for failure. The heavy top place or flange in the present construction may comprise the base flange of the tower structure to be supported from the foundation, or a separate set of bolts, suitably anchored relative to the upper portion of the foundation, may be used to anchor the tower structure base flange to the foundation.

The main object of this invention is to provide a pier foundation which will exert maximum resistance to upset.

Another object of this invention is to provide a concrete pier foundation which is maintained under heavy compression considerably in excess of expected tension forces when resisting upset of a supported tower, especially tall towers and structures.

Another important object of this invention is to provide a concrete pier foundation which may be formed in situ in remote locations.

A further object is to provide a pier foundation which can be formed from pre-cast concrete sections placed under heavy compression.

A still further object of this invention is to provide a pier foundation in which the concrete is heavily post-tensioned in the vertical direction after the concrete has hardened and cured to thereby stabilize tension and compression forces.

Another object in conjunction with the foregoing objects is to post-tension the concrete in a manner which avoids formation of failure loci at the upper surface of the concrete where the supported structure is attached.

A further object of this invention is to provide a pier foundation which may be formed in remote locations independent of the use of heavy drilling or pile driving equipment.

Still another important object of this invention is to provide a pier foundation which may be formed in situ independent of the use of reinforcing materials.

Another object of this invention is to provide a pier foundation whose components may be trucked to remote locations without excessive difficulty.

A further important object of this invention is to provide a pier foundation which is not restricted by soil conditions or ground water.

Still another object of this invention is to provide a pier foundation which will incorporate a minimum amount of concrete.

A further important object of this invention is to provide a pier foundation which may be readily adaptable to a pedestal configuration for elevation of the associated tower above high water level in flood zones.

Yet a further object of this invention is to provide a pier foundation that is resistant to erosion, scouring and sedimentation.

Another object of this invention is to provide a pier foundation which may be constructed to include a hollow upper portion for containment of equipment associated with the corresponding tower such as switch gear, transformers, etc. secure from the elements and vandalism.

Yet another important object of this invention is to provide a pier foundation including tensioned compression bolts incorporated into the foundation in a manner such that they may be periodically retorqued and substantially fully removed from the bores in which they are received in the event it becomes necessary to remove the foundation, in which instance the bolt receiving bores may be used as chambers to contain blasting material.

Still another object of this invention is to provide a pier foundation including a heavy top plate or ring as well as a heavy lower plate or ring and with each of the plates or rings being at least substantially continuous about an upstanding center axis of the foundation and with the concrete of the foundation between the plates or rings permanently placed under high unit compressive loading in excess of expected tension forces placed on the foundation.

A final object of this invention to be specifically enumerated herein is to provide a pier foundation in accordance with the preceding objects and which will conform to conventional forms of manufacture, be of simple construction and easy to erect so as to provide a structure that will be economically feasible, long lasting and relatively inexpensive.

These together with other objects and advantages which will become subsequentially apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
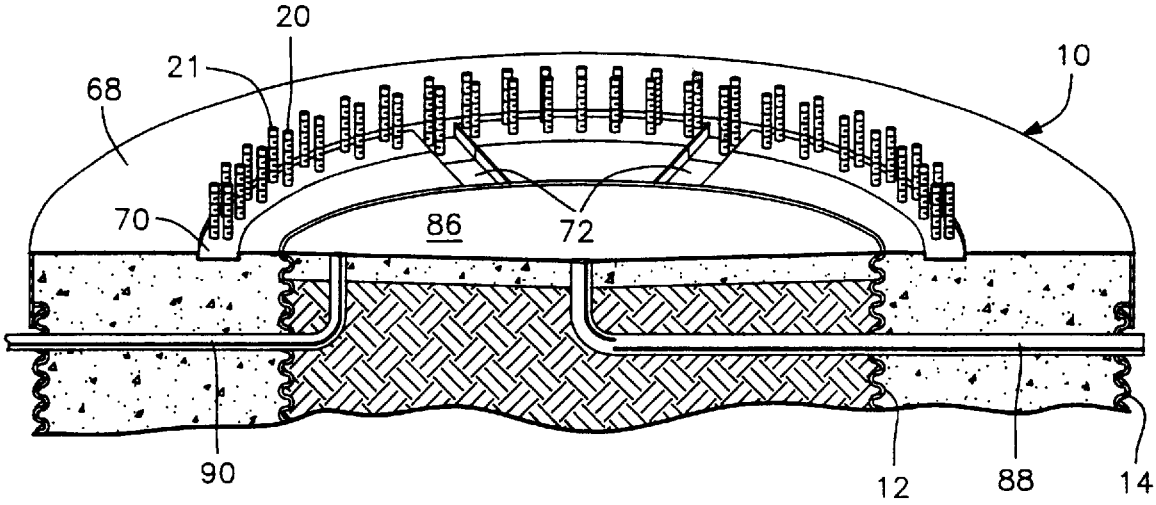
FIG. 1 is a fragmentary vertical sectional view of the upper portion of a completed pier foundation constructed in accordance with a preferred embodiment of the present invention and ready to have the base of a tower to be supported therefrom anchored to the foundation and utilized, in conjunction with tension bolts, to place the pier foundation in heavy compression.
Figure 2:
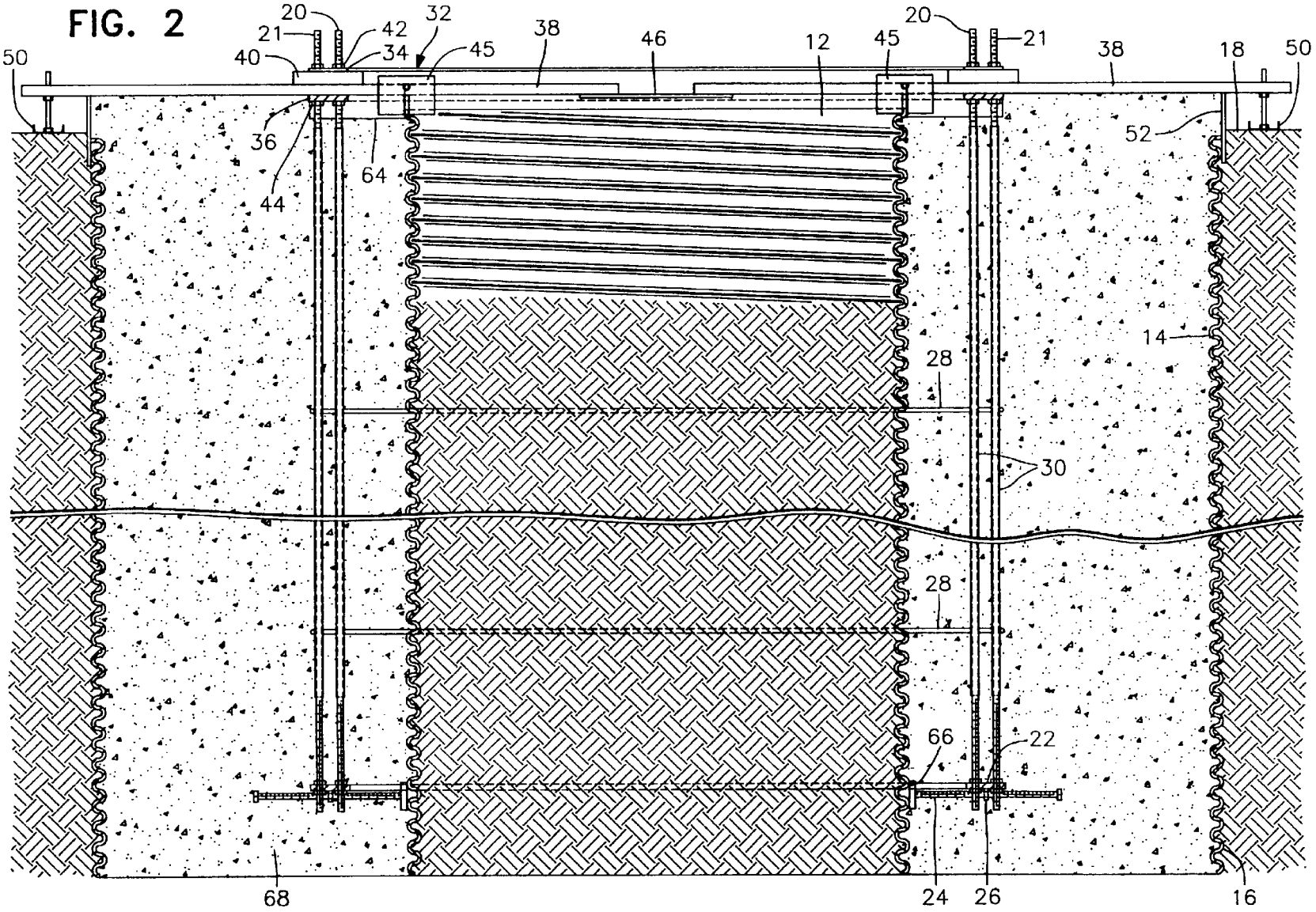
FIG. 2 is a fragmentary vertical sectional view illustrating the pier foundation of FIG. 1 immediately after pouring of the concrete thereof.
Figure 3:
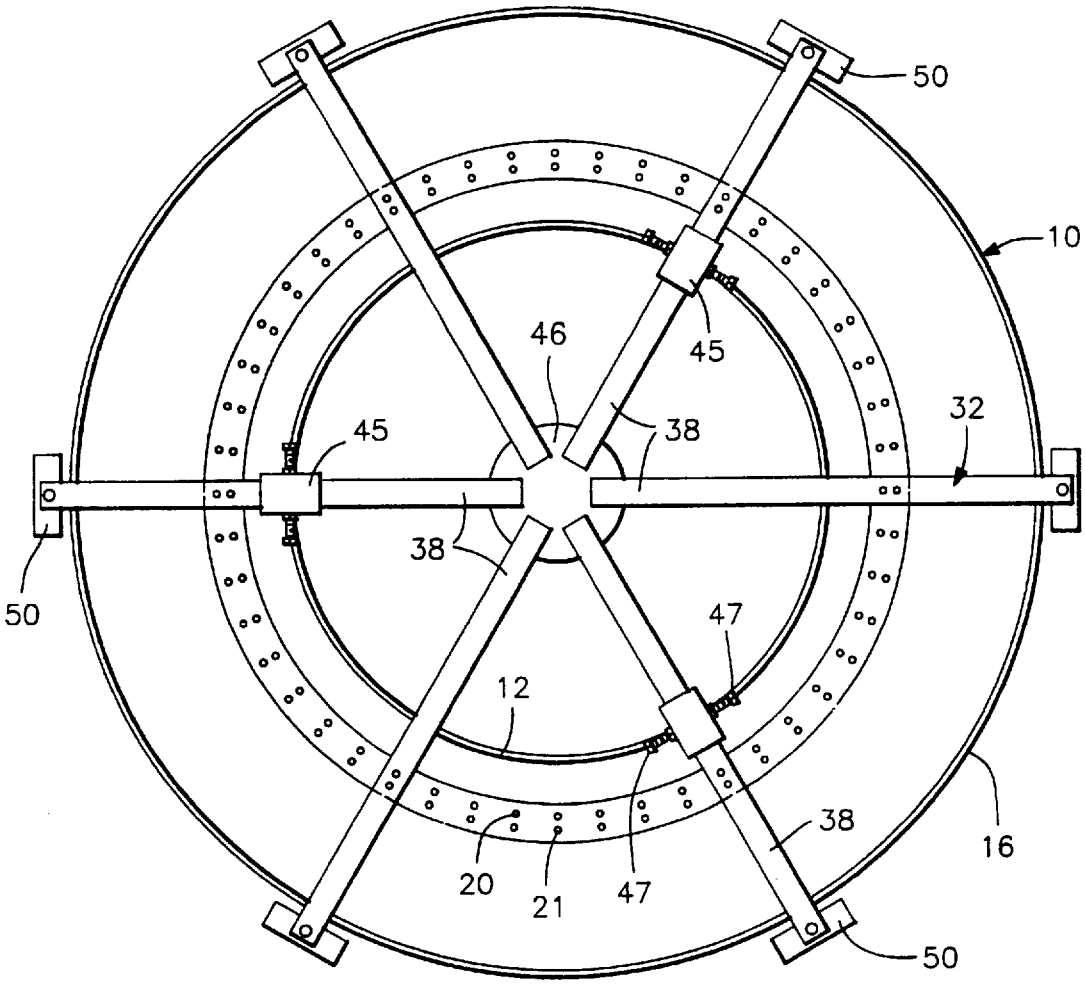
FIG. 3 is a top plan view of the assemblage illustrated in FIG. 2.

Referring now more specifically to the drawings, especially FIGS. 1 and 2, the numeral 10 generally designates the pier foundation of the instant invention. The foundation 10 preferably includes inner and outer upstanding corrugated pipe sections 12 and 14 which may, for example, be ten feet and eighteen feet, respectively, in diameter and generally twenty feet in length. The outer pipe 14 is initially placed within a hole or excavation 16 formed in the ground 18 and resting upon the bottom of the excavation 16. The inner corrugated pipe is then placed and positioned within the excavation 16 and the interior of the inner corrugated pipe 12 is partially back filled and the excavation 16 outwardly of the outer corrugated pipe 14 being initially partially back filled to stabilize the pipe sections generally in position within the excavation and relative to each other.

The foundation 10 additionally includes a series of tensioning bolts 20 and 21 spaced circumferentially about the annulus defined between pipe sections 12 and 14. Preferably, the tensioning bolts are in side-by-side pairs which extend radially from the center of the foundation. The inner ring of bolts 20 has a slightly shorter diameter than the outer ring of bolts 21. In the embodiment shown with the dimensions described in the preceding paragraph, forty-eight tensioning bolts 20 and forty-eight tensioning bolts 21, or a total of ninety-six, are provided. The rings of bolts have diameters which are several inches apart and diameters generally about 12 feet. However, it will be understood by those skilled in the art that the number of tensioning bolts and their circumferential positioning will depend upon the number and position of the holes of the anchoring feet of the tower or other structure to be supported on the foundation.

The lower ends of the bolts 20 and 21 are anchored relative to a lower annular plate or anchor ring 22, which preferably may be constructed of several circumferentially butted and joined sections, and the anchor ring 22 is radially spaced relative to the inner corrugated pipe 12 preferably by utilization of circumferentially spaced horizonal and radially extending positioning bolts 24 threaded through nuts 26 secured relative to the under side of the anchor ring 22 at points spaced circumferentially thereabout. Further, the bolts 20 and 21 have all but their opposite ends slidingly received through hollow tubes, preferably PVC pipes 30 which are sized to receive and loosely grip to bolts 20 and 21 but still permit free movement therethrough. As shown in the drawings, the hollow tubes or PVC tubing 30 need not extend through the entire vertical height of concrete 68, only through as much of the central portions and extending as close to the top and bottom as to allow tensioning bolts to extend evenly through the concrete during post-tensioning.

In lieu of the PVC pipes 30 and other suitable tubing which may be used or any other suitable method such as a lubricant coating or plastic wrap may be used to prevent bonding between the bolts 20 and 21 and the concrete to be subsequentially poured. It should be understood that tubes 30 serve to allow bolts 20 and 21 to move relatively freely through the concrete after curing so as to allow post-tensioning of the elongated rods. Any mechanism which allows the movement for post-tensioning is contemplated for this invention. In addition, rebar wraps 28 are preferably used and secured to the tubes 30 associated with outer bolts 21 at approximately five foot intervals along the vertical extent of the bolts 21 in order to maintain the bolts longitudinally straight during the pour of concrete.

The upper ends of the bolts 20 are supported from a template referred to generally by the reference numeral 32 and consisting of upper and lower rings (ring sections secured together) 34 and 36 between which upwardly opening radial channel members 38 and mounting blocks 40 received in the channel members 38 are clamped through the utilization of upper and lower nuts 42 and 44 threaded on the Dolts 20 and 21. The inner ends of the radial channel members 38 are joined by a center circular plate 46 and the inner portions of the channel members 38 include lateral stabilizers 45 in the form of inverted channel members downwardly embracingly engaged thereover and equipped with opposite side set screws 47 clamp engaged with the corresponding channel members 38. The depending flanges 49 of the channel members 45 are slotted as at 51 for stabilizing engagement with adjacent upper edge portions of the inner pipe 12 while the outer ends of the channel members 38 include threadingly adjustable channel member feet 50 abutingly engageable with the ground 18.

Figure 6:
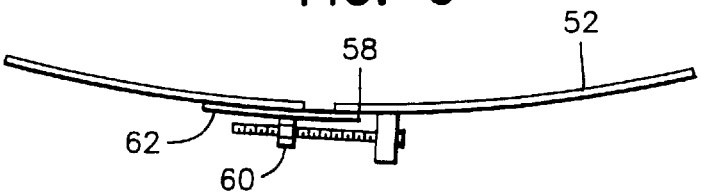
FIG. 6 is a fragmentary enlarged top plan view illustrating the manner in which the opposite ends of the upper peripheral form plate are lap-secured relative to each other.
Figure 7:
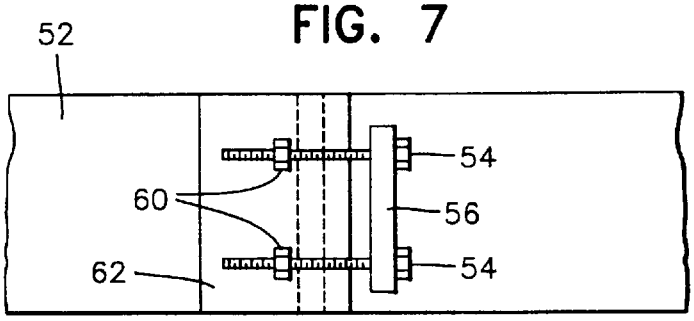
FIG. 7 is an elevational view of the assemblage illustrated in FIG. 6.
Figure 9:
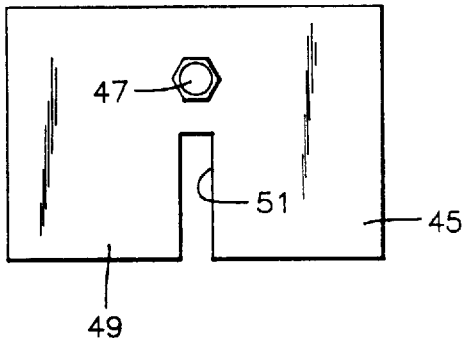
FIG. 9 is a side elevational view of a stabilizer channel for stabilizing the radial channel members, laterally, relative to the inner corrugated pipe.
Figure 10:
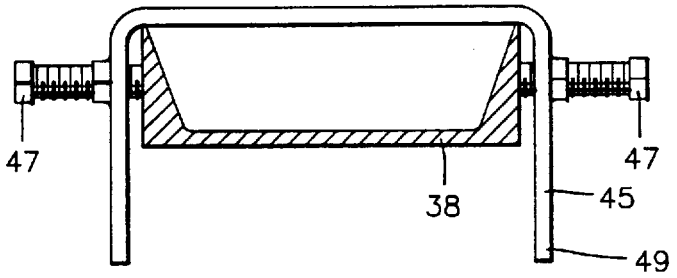
FIG. 10 is a vertical sectional view illustrating the stabilizer channel as mounted on one of the radial channel members.
Figure 11:
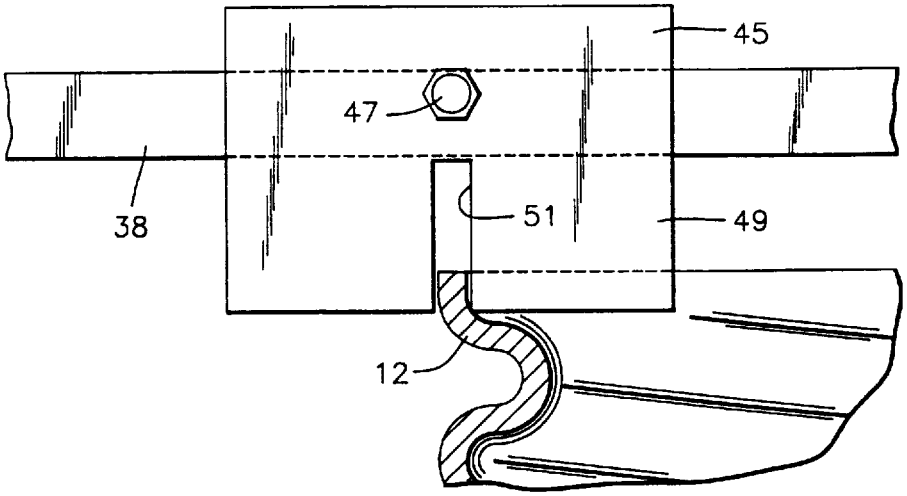
FIG. 11 is a side elevational view of the assembly of FIG. 10 as engaged with an upper edge portion of the inner corrugated pipe, the latter being fragmentarily illustrated in vertical section.

Further, a cylindrical form plate 52 is clamped about the upper end of the outer pine 14 and has its opposite ends secured together in overlapped relation as illustrated in FIGS. 6 and 7. The form plate ends are joined together by a pair of threaded bolts 54 rotatably received through a mounting lug 56 carried by one end 58 of the form plate 52 and threadedly secured through bolts 60 carried by the other end of the plate 52. A lap plate 62 is carried by the last mentioned form plate end and lapped over the form plate end 58 carrying the mounting lug 56.

Figure 4:
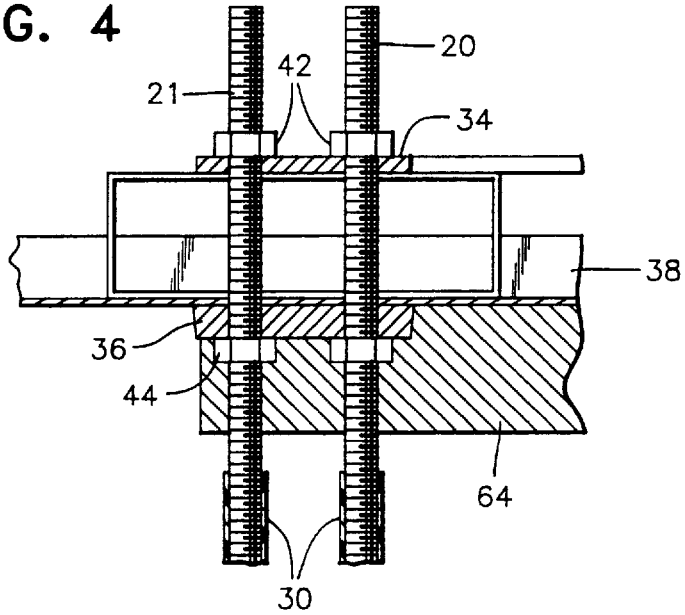
FIG. 4 is an enlarged fragmentary vertical sectional view illustrating the manner in which the upper template is used during the construction of the pier foundation in accordance with the present invention to maintain the upper ends of the tension bolts properly positioned.
Figure 5:
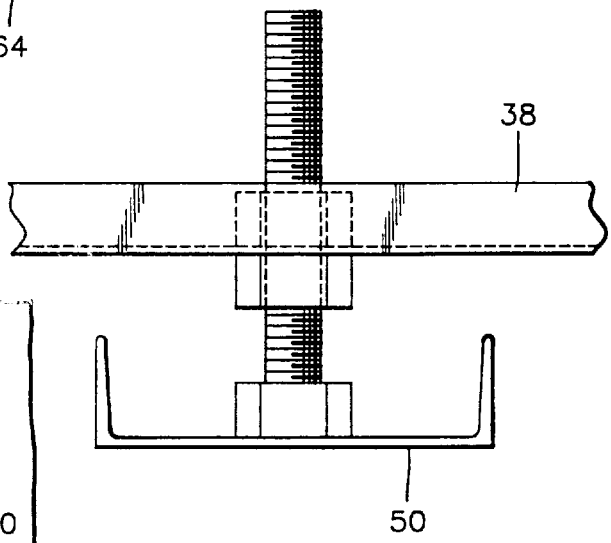
FIG. 5 is a fragmentary enlarged side elevational view of the outer end portion of one of the template radials illustrating the manner in which it may be adjusted relative to ground level outwardly of the outer periphery of the pier foundation.
Figure 8:
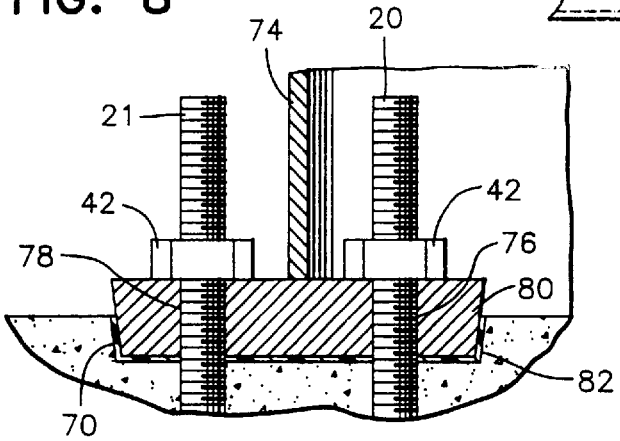
FIG. 8 is an enlarged fragmentary vertical sectional view illustrating the manner in which the tower lower end and base flange may be bolted to the upper end of the pier foundation in accordance with the present invention, while at the same time tensioning the tension bolts and placing the concrete of the foundation under heavy compression.

As may be seen from FIG. 4, the ring 36 is slightly downwardly tapered and a: each radial channel member 38 a blockout body 64 is provided for a purpose to be hereinafter more fully described. Further, each of the six radial channel members receive the corresponding pair of inner and outer bolts 20 and 21 therethrough and each of the blockout bodies 64 extends inwardly to the outer periphery of the inner corrugated pipe 12 and encloses the corresponding nuts 44 as may be seen in FIG. 4. Preferably, the blockout bodies 64 are constructed of any suitable readily removable material, such as wood or styrofoam.

After the template 32, the bolts 20 and 21 with their associated tubing 30, wraps 28 if necessary and the lower anchor ring 22 have been assembled, the bolts 24 are adjusted inwardly until the caps 66 carried by the bolt inner ends approximate the outer periphery of the inner pipe 12 with the inner set of bolts 20 generally equally spaced from the inner corrugated pipe 12. A crane is then utilized to lower the assembly down into the space between the inner and outer pipes 12 and 14 after the form plate 52 has been placed in position. Then, the feet 50 are adjusted in order to insure that the template 32 is level.

Thereafter, concrete 68 may be poured to the bottom of each of the radial channel members 38 and to the top of each of the blockout bodies 64. After the concrete 68 has hardened, the upper nuts 42 are removed and the entire template 32 including the upper and lower rings 34 and 36, the channel members 38 and attached feet 50 are lifted up from the bolts 20 and 21 and the form plate 52, the blockout bodies 64 being exposed from above by removal of the template 32 to thus allow removal of the blockout bodies 64.

When the concrete 68 has sufficiently hardened and it has been determined that the groove 70 is level, the nuts 44 are removed or threaded downwardly on the bolts 20 and 21 at least ¾ inch and a tower 74 to be supported from the foundation 10 is thereafter lowered into position with the upper exposed ends of the bolts 20 and 21 upwardly received through suitable bores 76 and 78 formed in the inner and outer peripheries of the heavy annular plate or base flange 80 of the tower 74 and the lower lug defining portion of the base flange 80 seated in the groove 70, a coating of high compression hardenable grout 82 preferably having been placed within the groove 70 prior to positioning of the lower end of the tower 74 downwardly upon the foundation 10. Initially, the upper nuts 42 are again threaded down onto the upper ends of the bolts 20 and 21 and preferably torqued to 50 foot pounds. The nuts 42 are thereafter sequentially torqued (in a predetermined pattern of tightening) preferably to about 600 foot pounds which places each of the bolts 20 and 21 under approximately 40,000 pounds tension at approximately ⅓ the stretch limit of the bolts 20 and 21.

If, on the other hand it has been found, after the concrete has sufficiently hardened and the blockout bodies have been removed, that the groove 70 is not level, the nuts 44 are adjusted to define a level plane co-incident with the highest portion of the groove 70. Then, high strength grout 82 is poured into the groove 70 and the tower 74 is lowered into position, seated within the groove 70 on the high side thereof and supported by the nuts 44 at the other locations about the foundation 10, the nuts 42 then being installed and only initially tightened. After the grout 82 has hardened, the nuts 42 are sequentially torqued in the same manner as set forth hereinbefore.

By placing the bolts 20 and 21 under high tension, the cylindrical structure comprising the concrete 68 is placed under heavy unit compressive loading from the upper end thereof downwardly to a level adjacent the lower end of the cylindrical structure, and the unit compressive loading is considerably greater than any upset tensional forces which must be overcome to prevent upset of the tower 74 and foundation 10. As a result, the concrete 68 is always under compression and never subject to alternating compression and tension forces.

As may be seen from FIG. 2, the back fill within the inner pipe 12 may be completed considerably below the surface of the ground 18. In such instance, the interior of the upper portion of the pipe 12 may be used to store maintenance equipment, electrical control equipment or other equipment, in which case the lower end of the tower 74 will be provided with a door opening (not shown).

On the other hand, the back fill within the inner pipe 12 may be completed to substantially ground level and provided with a poured concrete cap 86, as shown in FIG. 1. The cap 86 may be sloped toward the center thereof and provided with a drainage conduit 88 and a conduit 90 for electrical conductors (not shown) also may be incorporated in the foundation 10.

In estimating the cost of completing a foundation constructed in accordance with the present invention and taking into consideration less expensive excavation and back fill costs, the absence of reinforcing steel bars and the use of a smaller volume of concrete, the total cost would be in the neighborhood of $24,000 For a foundation having an outside diameter of fourteen feet, an inside diameter of nine feet and a height of approximately twenty-five feet. On the other hand, the estimate for forming a similar conventional pier foundation is in the neighborhood of $29,000 and the estimate for constructing a mat foundation also suitable for supporting a 150 foot tube tower is approximately $30,000 to $31,000, these figures being exclusive of excessive labor costs. Also, it will be noted that labor and transportation costs are considerably greater for pier and conventional mat foundations, especially if the location of the foundation is remote and access thereto includes portions other than on paved roadways.

It is to be noted that the foundation 10 may be used for supporting many different types of towers, but its reduced cost at remote locations and its resistance to upset independent of alternating compression and tension forces makes it particularly well adaptable for use in supporting windmill towers.

Further, the utilization of corrugated inner and outer pipes 12 and 14 greatly increases the resistance to upset and by utilizing a cylindrical foundation which is hollow and not closed at the bottom of its interior, the back fill within the inner corrugated pipe 12 increases the resistance of the bottom of the foundation to lateral slippage relative to the ground immediately beneath the concrete 68.

Figure 12:
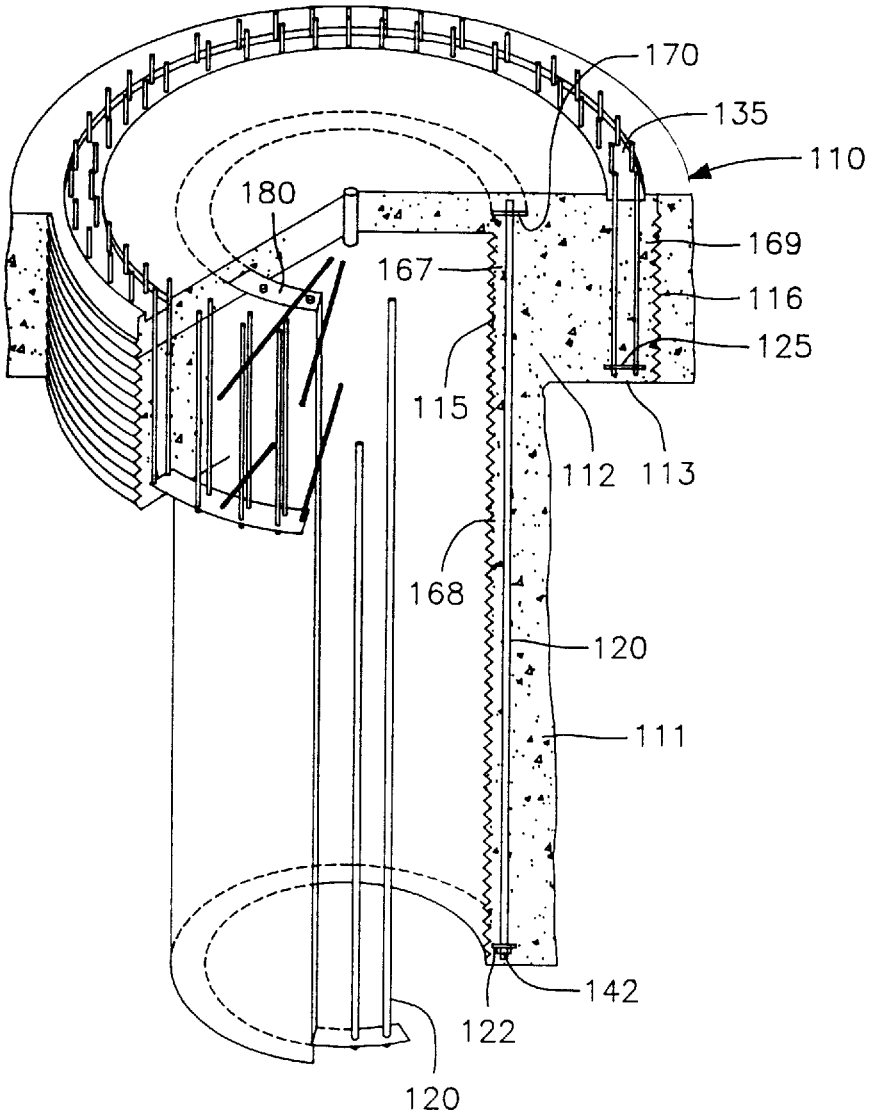
FIG. 12 is a fragmentary isometric view of a modified form of pier foundation incorporating a lower portion with a radially thinner wall and an upper portion with a radially thicker wall defining a shouldered upper end of said pier foundation, with portions of the foundation being broken away and illustrated in vertical section.
Figure 13:
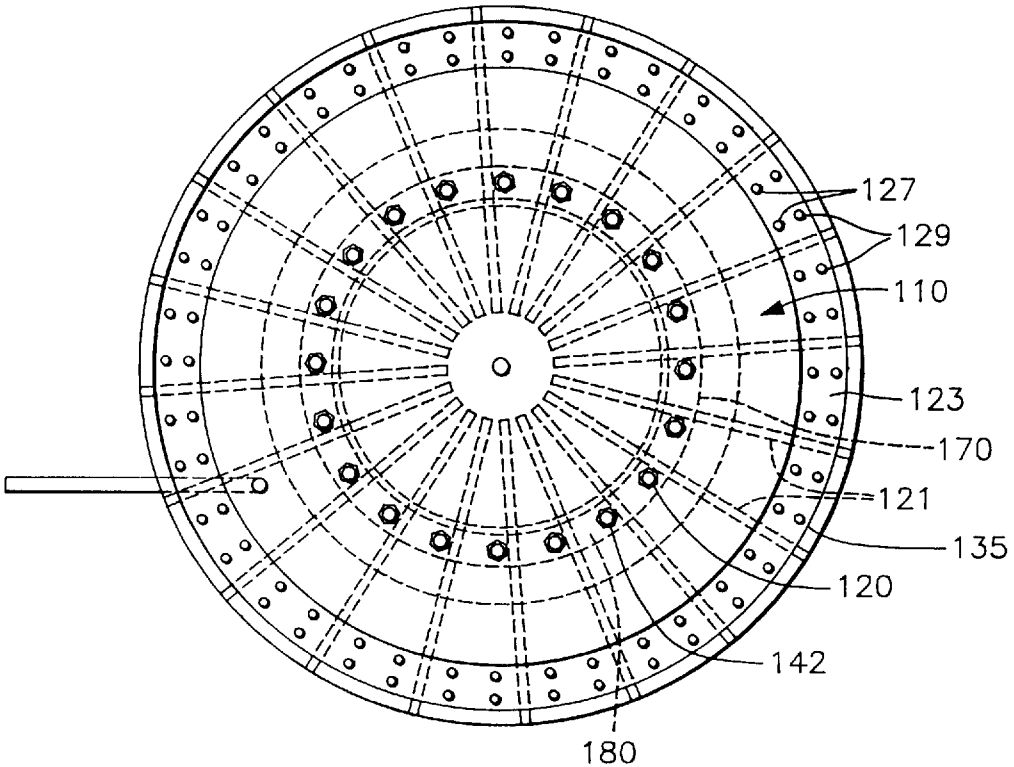
FIG. 13 is a top plan view of the pier foundation illustrated in FIG. 12.

Referring now more specifically to FIG. 12, a modified form of concrete pier foundation is designated generally by the reference numeral 110. The foundation 110 is similar in many respects to the foundation 10, but includes a radially thin lower end portion 111 and a radially thick upper end portion generally designated by the numeral 112, defining a radially outwardly extending and downwardly facing shoulder at 113. In this form of the invention, an elongated inner corrugated pipe is preferably provided at 115 and a shorter outer corrugated pipe is preferably provided at 116. The corrugated pipe 115 preferably extends substantially the full height of the foundation 110 and the outer corrugated pipe 116 preferably extends only substantially the height of the upper end portion 112.

Figure 15:
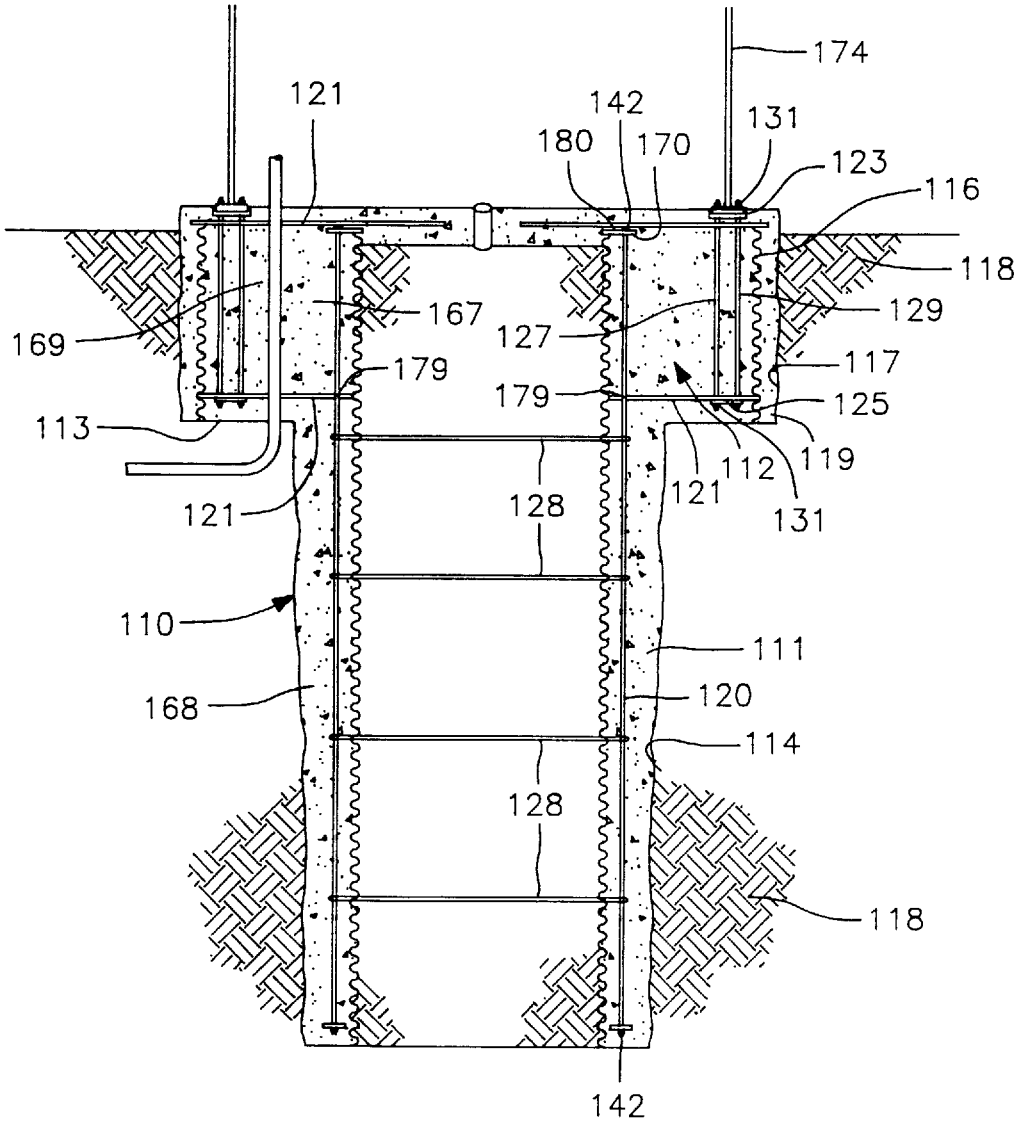
FIG. 15 is a vertical sectional view of the pier foundation illustrated in FIGS. 12 and 13 and with the lower end mounting flange of a tower structure or the like mounted therefrom in the manner illustrated in FIG. 14.

A lower anchor ring 122 is embedded in the lower end portion 111 adjacent the lower end thereof, and an upper end heavy plate or ring 180 is seated in a groove 170 formed vertically above ring 122 around an inner section 167 of the upper end portion 112 of the concrete 168, see FIG. 15. Heavy tensioning bolts or rods 120, sheathed preferably in PVC pipes, extend between the rings 122 and 180 and the upper and lower ends of the bolts 120 are slidingly received through bores provided therefore in the rings or plates 122 and 180 and are secured therethrough by nuts 142 which heavily tension the rods 120. The rods 120 are slidably received through the PVC tubes or, alternately, are wrapped in tape or other mechanism which allows the rods 120 to stretch relative to the cured concrete 168 when they are heavily tensioned. Thus, the rods are capable of placing the entire lower end portion ill and inner section 167 of the upper end portion 112 of concrete 168 under high unit compression.

Although the corrugated pipe 115 extends the full length of the foundation 110 on the interior thereof, the outer surface of the lower end portion 111 is defined by an excavated bore 114 formed in the surrounding ground 118. However, the outer boundary of the upper end portion 112 is defined by the outer corrugated pipe 116, the ground bore 114 including a diametrically enlarged counterbore 117 in which a three sack cement and sand slurry 119 is placed and allowed to harden.

As with the foundation 10, the foundation 110 includes vertically spaced circumferentially extending rebar wraps 128. Further, the upper end portion 112 includes a radially extending shoulder section 169 which surrounds the inner section 167, and forms the shoulder 113 of foundation 110. Circumferentially spaced upper and lower radially arranged rebars 121 are spaced between adjacent bolts or rods 120 which act to radially reinforce the concrete upper end portion 112, including the inner section 167 and the shoulder section 169.

Figure 14:
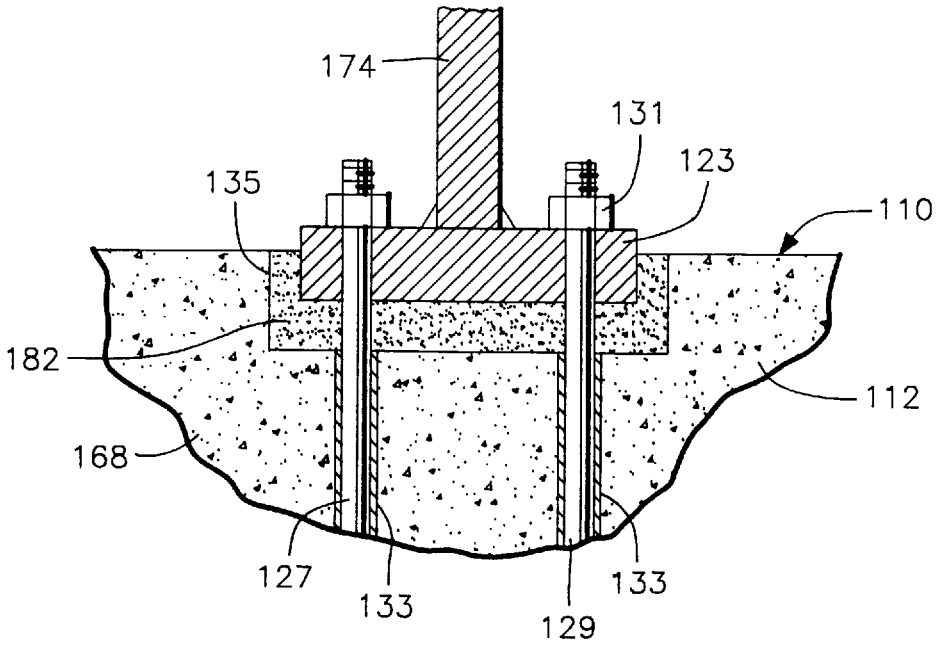
FIG. 14 is an enlarged fragmentary vertical sectional view illustrating the manner in which a lower mounting flange of a tower structure or the like may be mounted from the outer set of bolts of the foundation illustrated in FIGS. 12 and 13.

In addition, the upper end portion 112 includes upper and lower heavy rings or plates 123 and 125 through which preferably inner and outer sets of circumferentially spaced bolts 127 and 129 are secured through the utilization of nuts 131, the rods 127 and 129 being slidingly received preferably through PVC tubes 133, see FIG. 14. The ring 125 is embedded adjacent the bottom of the shoulder section 169 of the upper end portion 112, and the ring 123 is received in a groove 135 opening upwardly through the top surface of shoulder section 169. Ring 123 is preferably seated in a grout 182 corresponding to grout 82. Also, the heavy ring or plate 123 can comprise the base flange of an associated tower 174, corresponding to the tower 74. Thus, a single set of long bolts 120 place the foundation 110 under heavy unit compression loading throughout substantially its entire length and the bolts 127 and 129 place the shoulder section 169 under heavy unit compression loading.

An advantage of the foundation 110 over the foundation 10 is that a lesser number of expensive long rods 120 can be used. Nevertheless, the foundation 110 is maintained under high unit compression loading throughout its length and the radially thicker upper portion 112 or shoulder 169 of the foundation 110 also is maintained under high unit compression loading through utilization of the same bolts 127 and 129 that can secure the base flange 123 of the tower 174 to the foundation 110.

Figure 16:
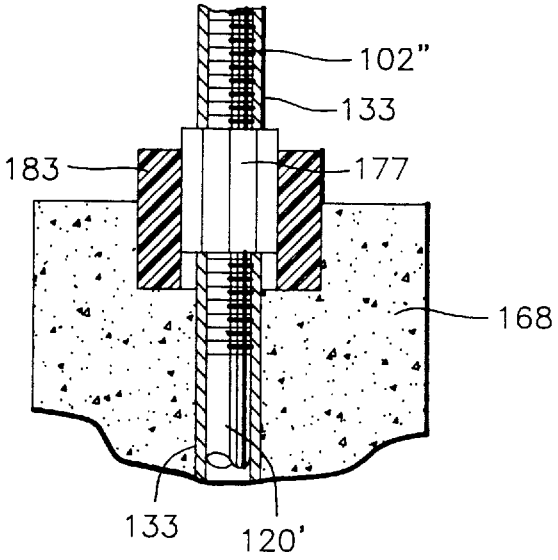
FIG. 16 is an enlarged fragmentary vertical sectional view illustrating the manner in which the inner set of tension bolts or rods used in the foundation illustrated in FIGS. 12 and 13 each may include a pair of releasably joined rod or bolt sections.

With attention now invited more specifically to FIG. 16, there may be seen a threaded coupler or connector 177 which may be utilized as at 179 in FIG. 15 to removably connect a lower bolt or rod section 120' to an upper bolt or rod section 120", each of the sections 120' and 120" being sheathed in a PVC tube 133. In addition, the threaded connector 177 is preferably received within a styrofoam jacket or sleeve 183, or other sleeve material thereby allowing both the rod sections 120' and 120" as well as the coupler 177 to shift slightly relative to the concrete 168 and the coupler to move vertically under rod tensioning during post-compression.

Of course, the concrete 168 of the foundation 110 is poured in place after the corrugated pipes 115 and 116 are properly positioned in substantially the same manner in which the foundation 10 is poured. One use for the rod or bolt sections 120' and 120" as well as the couplers 177 illustrated in FIG. 16, is to facilitate the decommission of the pier foundation, such as any of pier foundations 10, 110, 210 and 310. By removing the upper rod or bolt sections 120", explosive charges may be placed downwardly into the empty bore upper end portions generally to the level of the downwardly facing shoulder. The explosive charges may then be detonated in order to separate the pier upper end portion from the lower end portion. Thereafter, the separated and fractured upper end portion may be removed and fill dirt may be placed over the remaining lower end portion of the foundation.

Figure 17:
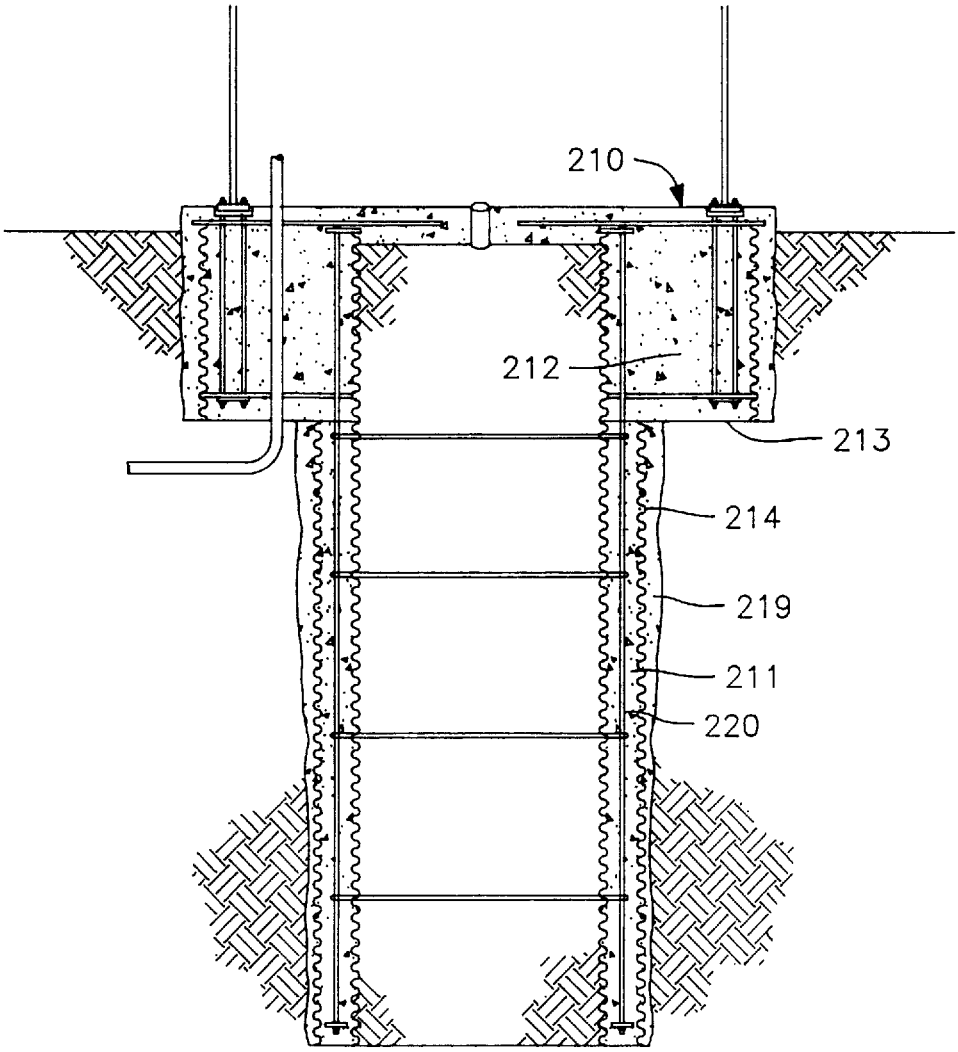
FIG. 17 is a vertical sectional view similar to FIG. 15, but illustrating a second modified form of pier foundation.

With attention now invited more specifically to FIG. 17, a second modified form of foundation 210 is shown. The foundation 210 is very similar to the foundation 110 except that the lower end portion 211 thereof includes an outer corrugated pipe 214 and the lower end portion 211 may be poured separately from the upper end portion 212. Inasmuch as the lower end portion 211 utilizes an outer corrugated pipe 214, a three sack cement/sand slurry 219 similar to the slurry 119 is provided exteriorly of the corrugated pipe 214.

When forming the foundation 210, the lower end portion 211 is first poured along with the slurry 219 up to the level of shoulder 213 which corresponds to the shoulder 113 of foundation 110. The plastic sheathed bolts or rods 220 corresponding to the rods 120 of course project upwardly a substantial distance beyond the lower end portion 211 and are subsequently encased in the concrete poured to form the upper end portion 212. Alternatively, a suitable coupler or connector, such as shown in FIG. 16, may be used to couple separate sheathed bolts or rods 220 extending through each lower end portion 211 and upper end portion 212, respectively. In this construction, the lower end portion is formed with sheathed rods 120 extending slightly above the upper surface. Separate sheathed rods 120 for the upper end portion are suitably coupled to the lower end rods and the upper end portion is poured. Otherwise, the foundation 210 is substantially identical to the foundation 110.

Figure 18:
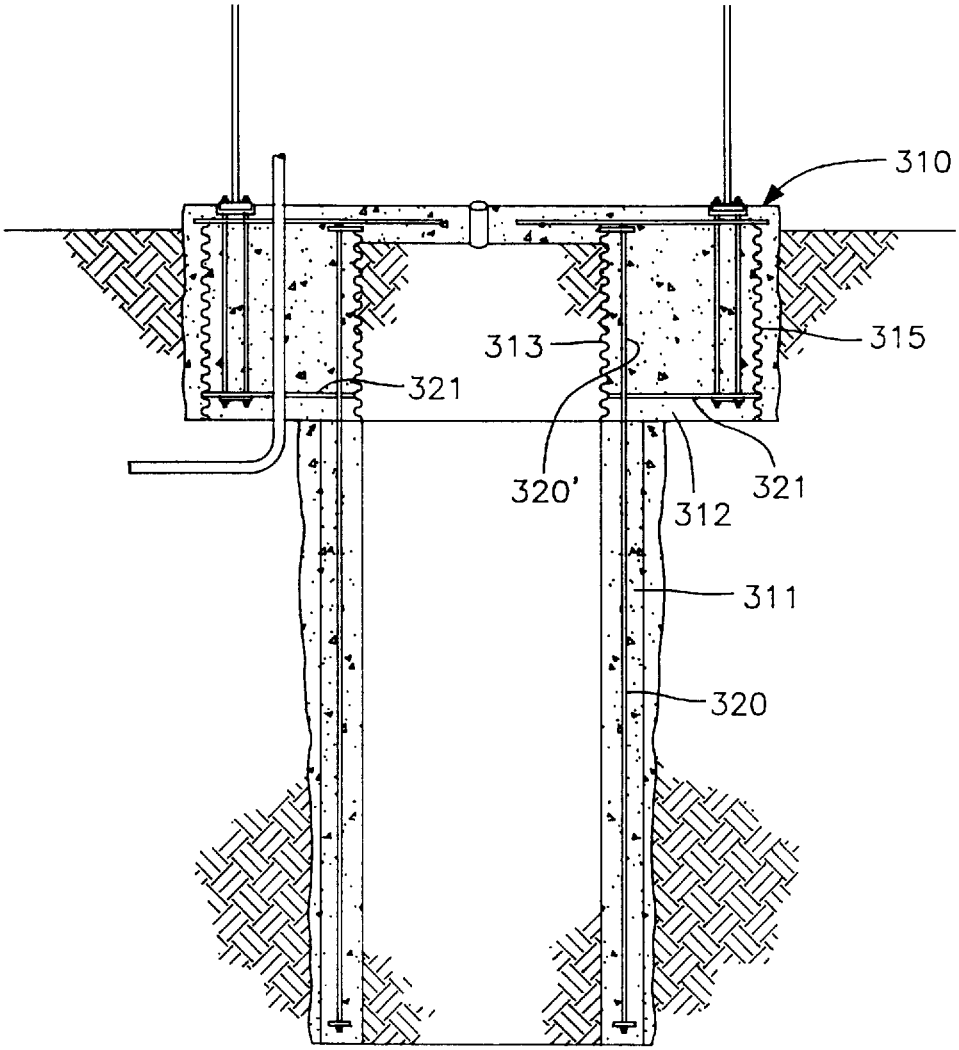
FIG. 18 is a vertical sectional view similar to FIGS. 15 and 17, but illustrating a third modified form of pier foundation.

With attention now invited more specifically to FIG. 18, a third modified form of foundation is referred to in general by the reference numeral 310. Foundation 310 is very similar to the foundation 210, except that the lower end portion 311 is precast. The upper end portion 312 is preferably pour in-situ between an interior corrugated pipe 313 and exterior corrugated pipe 315. The upper ends of the rods 320 corresponding to the rods 120 may extend upwardly beyond the upper end of the lower end portion 311 if the rods 320 are full length. If so, they are received through bores 320' formed in the upper end portion 312 as the latter is placed downwardly over the lower end portion 311. Alternatively, separate sheathed rods for the upper end portion 312 and lower end portion 311 can be suitably connected or coupled at their facing surfaces. In addition, inasmuch as the lower end portion 311 is precast, rebar wraps corresponding to the wraps 128 are not needed. However, radial rebars 321 corresponding to the rebars 121 are preferably utilized to radially reinforce the upper end portion 312.

In addition, lower end portion 311 may be precast in several substantially identical vertical sections, each with requisite sheathed rods disposed therein. The ends of the rods can be suitably coupled during site construction of the foundation with the couplings appropriately sleeved to allow the necessary vertical movement during post-compression. Any suitable coupler and sheathing can be used so long as it allows for the requisite post-compression required in accordance with the present invention. Further, while not preferred, it may be possible to precast the upper end portion with the requisite sets of sheathed rods and couplers.

In each instance, the foundations 10, 110, 210 and 310 are maintained under high unit compression throughout substantially the entire length thereof by the utilization of the heavily tensioned substantially full length bolts or bolt constructions, e.g. with couplers, extending therethrough from the heavy top ring to the embedded lower ring and with the bolts or bolt constructions being free to stretch relative to the concrete as the bolts or bolt constructions are tensioned. The tensioning of the bolts is such that the high unit compression of the foundation exceeds expected tension forces exerted on the foundation by a tower or similar structure mounted thereon.

The tower base flange comprises the heavy ring utilized in the foundation 10, but the foundations 110, 210 and 310 each include a radially thickened upper end portion defining an enlarged shoulder at the upper end portion of the foundation. A second series of circumferentially spaced heavily tensioned bolts are utilized between heavy upper and lower rings supported from the outer peripheral portion of the shoulder. The associated tower base flange can comprise the heavy upper ring of the shoulder portion of the foundation, the shoulder portion of the foundation also being under heavy unit compression.

The foregoing is considered as illustrative only of the principles of the invention. Further, since numerous other modifications and changes readily will occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination, a large tower for support of power lines, street lighting and signals, bridge supports, wind turbines, commercial signs, freeway signs, ski lifts and the like which can be subject to a high torque moment, said tower having a rigid base flange at its lower end, and a pier foundation having a generally cylindrical upright structure of cementitious material, a substantial portion of which is embedded in the ground, said upright structure including a diametrically enlarged upper end section having a top and a bottom, said bottom defining a downwardly facing shoulder extending about a lower end portion of said upright structure, said upright structure being under heavy unit compression loading by a first set of upright tension rods disposed in and extending substantially the entire length of said upright structure and generally spaced about a center axis of said upright structure, a second set of upright tension rods disposed in and extending substantially the entire length of said diametrically enlarged upper end section and generally spaced about said center axis, sheathing surrounding substantially the entire length of the rods of said second set to shield said rods against bonding to said cementitious material, said tension rods of said second set including lower ends affixed to an anchor structure adjacent the bottom of said diametrically enlarged upper end section and exposed upper ends slidingly received through openings in said rigid base flange bearing downwardly upon said diametrically enlarged upper end section and a plurality of tensioning elements connected to said upper ends for placing said rods of said second set under heavy tension and said diametrically enlarged upper end section between where the lower ends of said rods of said second set are affixed to said anchor structure and below said rigid base flange, under heavy unit compression loading so that said upright structure will withstand high torque moments imparted to said tower.

2. The combination of claim 1 wherein the upright tension rods of said first set are surrounded by sheathing substantially the entire length of said rods to shield said rods against bonding to said cementitious material, said tension rods of said first set also including lower ends affixed to a second anchor structure in a lower portion of said upright structure and exposed upper ends slidingly received through openings in a rigid plate bearing downwardly upon an upper portion of said upright structure, and a plurality of tensioning elements connected to said upper ends of said first set rods for placing said rods under heavy tension so that said upright structure, between where the lower ends of the first set rods are affixed and below said rigid plate, is under heavy unit compression loading.

3. In combination, a large tower for support of power lines, street lighting and signals, bridge supports, wind turbines, commercial signs, freeway signs, ski lifts and the like which can be subject to a high torque moment, said tower having a rigid base flange at its lower end, and a pier foundation having an upright structure of cementitious material, a substantial portion of which is embedded in the ground, said upright structure having at least one set of upright tension rods disposed therein with sheathing surrounding substantially the entire length of said rods to shield said rods against bonding to said cementitious material, said tension rods including lower ends affixed to an anchor structure in a lower portion of said upright structure and exposed upper ends slidingly received through openings in said rigid base flange bearing downwardly upon an upper portion of said upright structure, and a plurality of tensioning elements connected to said rod upper ends for placing said rods under heavy tension and said upright structure, between where the lower ends of said rods are affixed to said anchor structure and below said rigid base flange, under heavy unit compression loading so that said upright structure will withstand high torque moments imparted to said tower.

4. The combination of claim 3 wherein said rods are bolt assemblies and said tensioning elements are threaded nuts threaded onto mating threads of said rod upper ends.

5. The combination of claim 3 wherein the upright structure of said pier foundation is generally cylindrical and has an open central portion which is substantially back filled.

6. The combination of claim 5 wherein said rigid base flange and said rod anchor structure are in the form of a heavy plate or ring having a center which is generally coincident with the central axis of said generally cylindrical upright structure.

7. A tensionless pier foundation including an upright structure of cementitious material and including an upper at least one set of upright tension bolt assemblies disposed in said upright structure and spaced about a center axis thereof, said bolt assemblies including lower ends anchored to an anchor structure embedded in a lower portion of said upright structure and exposed threaded upper ends projecting upwardly adjacent said upper end, said bolt assemblies being shielded against bonding of said cementitious material thereto, a heavy base flange seated upon said upper end of said upright structure and having openings formed therethrough through which said threaded upper ends are slidingly received, and a plurality of nuts threaded on said threaded upper ends and tightened downwardly upon said heavy base flange sufficiently to place said bolt assemblies under heavy tension, to thereby place all of said upright structure, above said anchor structure and beneath said heavy base flange, under a heavy unit compression load extending fully about said center axis.

8. The pier foundation of claim 7 wherein said upright structure includes upper and lower end portions, said tension bolts including removably threadingly coupled upper and lower bolt sections, said upper and lower bolt sections extending through said upper and lower end portions, respectively, of said upright structure of cementitious material.

9. The tensionless pier foundation of claim 7 including an upstanding tower having upper and lower ends, said lower end being fixed to said heavy base flange.

10. A tensionless pier foundation including an upright structure of cementitious r al and including upper and lower ends, at least one set of upright tension bolt assemblies disposed in said upright structure and spaced about a center axis thereof, sheathing surrounding substantially the entire length of said bolt assemblies to shield said bolt assemblies against bonding of said cementitious material thereto said tension bolt assemblies including lower ends anchored to an anchor plate embedded in a lower portion of said upright structure and exposed threaded upper ends slidingly received through openings provided therefor in a rigid plate seated tightly upon said upper end of said upright structure, and a plurality of nuts threaded on said threaded upper ends and tightened downwardly upon said rigid plate sufficiently to place said bolts under heavy tension to thereby place all of said upright structure, above said anchor structure and beneath said rigid plate, under a heavy unit compression load extending fully about said center axis.

11. The tensionless pier foundation of claim 10 including an upright tower having upper and lower ends, said lower end being fixed to said rigid plate.

12. An upright generally cylindrical pier foundation of cementitious material and including an upright center axis and upper and lower end portions, a heavy lower anchor ring embedded in and extending about said lower end portion adjacent the lower end thereof, a heavy upper base ring seated against the upper end of said upper end portion, a first set of upright tension rods spaced about said center axis, having upper and lower ends anchored relative to said upper and lower rings, respectively, and being heavily tensioned, said rods extending through said cementitious material and being shielded against bonding of said cementitious material thereto, whereby said upper and lower rings distribute the heavy tensional forces of said rods throughout said upright pier foundation between said rings to place said foundation under heavy unit compression loading extending fully about said center axis.

13. The pier foundation of claim 12 wherein said upper end portion is diametrically enlarged and defines a downwardly facing circumferential shoulder extending about the upper extremity of said lower end portion of said foundation, a second heavy anchor ring embedded in and extending about said upper end portion above said shoulder radially outwardly of said first set of rods, a second heavy upper ring downwardly seated against said upper end portion, a second set of upright tension rods spaced about said center axis, having upper and lower ends anchored to said second upper and anchor rings, respectively, and being heavily tensioned to thereby also place said upper end portion, between said second rings, under heavy unit compression loading extending fully about said center axis.

14. The pier foundation of claim 13 wherein said lower end portion is precast and said upper end portion includes longitudinally corrugated inner and outer surfaces conforming to and tightly bound by cylindrical inner and outer metal corrugated pipes.

15. The pier foundation of claim 13 wherein said pier foundation is of monolithic construction and includes a longitudinally corrugated inner surface tightly bound by a cylindrical inner metal corrugated pipe, said upper end portion including a longitudinally corrugated outer surface conforming to and tightly bound by an outer cylindrical metal corrugated pipe.

16. The pier foundation of claim 13 wherein said pier foundation is of monolithic construction, said first set of tension rods including removably threadingly coupled upper and lower rod sections said upper and lower rod sections extending through said upper and lower end portions, respectively, of said pier foundation.

17. The pier foundation of claim 13 wherein said upper and lower end portions are separately formed in situ.

18. The tensionless pier foundation of claim 17 wherein said pier foundation includes a longitudinally corrugated inner surface and said upper portion includes a longitudinally corrugated outer surface, said inner and outer surfaces conforming to and tightly bound by cylindrical inner and outer metal corrugated pipes, respectively.

19. The pier foundation of claim 17 wherein said first set of tension rods include removably threadingly coupled upper and lower rod sections said upper and lower rod sections extending through said upper and lower end portions, respectively, of said pier foundation.

* * * * *